US009173513B2

(12) United States Patent
Bogani et al.

(10) Patent No.: US 9,173,513 B2
(45) Date of Patent: Nov. 3, 2015

(54) DIVIDED SALT DISPENSER WITH MULTI-COLORED SALT

(76) Inventors: Joaquin Bogani, Palm Beach, FL (US); Ronald J. Bogani, Wellington, FL (US)

( * ) Notice: Subject to any disclaimer, the term of this patent is extended or adjusted under 35 U.S.C. 154(b) by 939 days.

(21) Appl. No.: 12/612,833

(22) Filed: Nov. 5, 2009

(65) Prior Publication Data

US 2011/0101027 A1 May 5, 2011

(51) Int. Cl.
*A47G 19/00* (2006.01)
*A47G 19/24* (2006.01)

(52) U.S. Cl.
CPC ..... *A47G 19/24* (2013.01)

(58) Field of Classification Search
CPC ..... A47G 19/24
USPC ..... 222/142.1, 142.4, 143, 78; 220/553
See application file for complete search history.

(56) References Cited

U.S. PATENT DOCUMENTS

| | | | | |
|---|---|---|---|---|
| 2,560,755 | A * | 7/1951 | Bendel | 222/78 |
| 5,597,596 | A * | 1/1997 | Henderson | 426/242 |
| 2002/0130208 | A1 * | 9/2002 | Pedersen | 241/169.1 |
| 2005/0173440 | A1 * | 8/2005 | Johnson | 220/553 |
| 2006/0057370 | A1 * | 3/2006 | Pasquier et al. | 428/350 |
| 2008/0223877 | A1 * | 9/2008 | Gevorgian | 222/173 |

* cited by examiner

*Primary Examiner* — Kevin P Shaver
*Assistant Examiner* — Nicholas J Weiss
(74) *Attorney, Agent, or Firm* — Patents on Demand P.A.; Brian K. Buchheit; Scott M. Garrett

(57) ABSTRACT

A salt dispenser including a dispenser body, two or more salt chambers, an outflow opening, and human consumable colored salt. The dispenser body can have a visible indicia for a colored themed entity or event, such as a sport's team or holiday. The salt chambers can be isolated from each other to prevent salt in one of the chambers from mixing with salt of any other of the chambers. Each of the chambers can include a transparent region though which salt within the chamber is viewable. The outflow opening can dispense granules of human consumable salt. The human consumable colored salt can include salt having different colors, each of the different colors being contained in a different one of the salt chambers. The different colors can include colors of the color themed entity or event.

20 Claims, 3 Drawing Sheets

100B

DIVIDED SALT DISPENSER WITH MULTI-COLORED SALT

BACKGROUND

The present invention relates to the field of dispensers and, more particularly, to divided salt dispenser with multi-colored salt.

Special occasions such as holidays and parties are often enhanced by decorations and accessories. Parties such as "game day" parties and victory celebration gatherings are immensely successful when sports team colors and paraphernalia are displayed. Paraphernalia, such as themed accessories, frequently include team colored napkins, patterned table cloths, caricature (e.g., "bobblehead") dolls of team members, and various decorative items. One accouterment which can add ambience to any gathering is themed shaped/colored salt shakers. An entire industry has grown up around the manufacturing of these specialty salt shakers. Although there are a wide variety of shakers to choose from, there exists a dearth of sports related salt shakers. Sports fans are relegated to salt shakers which lack appeal and customizability.

Further, establishments such as restaurants and bars are often looking for ways to add more atmosphere to sports related events. Providing salt shakers associated with the patron's favorite team can add meaningful value to a dining experience. However, since there are a vast quantity of sports teams, it is often impractical for establishments to offer this unique touch. This would result in the establishments purchasing a significantly large quantity of team related salt shakers, which is not cost effective.

BRIEF SUMMARY

One aspect of the disclosure is for a salt dispenser having a dispenser body, a set of salt chambers, and an outflow opening. The dispenser body can have a shape characteristic of a type of sport, such as a shape of a type of ball used in said sport, a type of helmet worn when participating in the sport, a jersey worn when participating in the sport, a ball manipulating device carried and used by a participant of the sport, a vehicle driven when participating in the sport (e.g., racing), and a player of the sport. The dispenser body can include visible indicia for a specific team for the sport. The specific team can have a color theme of at least two colors associated with the specific team. The visible indicia can include a team name, a team logo, and/or a team abbreviation. The salt chambers can contain human consumable salt that is viewable through the dispenser body. Each of the salt chambers can be isolated from each other to prevent salt from one of the salt chambers from mixing with salt of any other of the salt chambers. The human consumable colored salt can include salt having different colors, each of the different colors being contained in a different one of the chambers. The different colors can include at least two colors associated with the specific team. The outflow opening can be for dispensing granules of human consumable salt from the salt dispenser to edible food. The outflow opening can be formed so that human consumable salt from different salt chambers is concurrently dispensed to the edible food when the salt dispenser is utilized.

Another aspect of the disclosure includes a salt dispenser including a dispenser body, two or more salt chambers, an outflow opening, and human consumable colored salt. The dispenser body can have a visible indicia for a colored themed entity or event, such as a sport's team or holiday. The salt chambers can be isolated from each other to prevent salt in one of the chambers from mixing with salt of any other of the chambers. Each of the chambers can include a transparent region though which salt within the chamber is viewable. The outflow opening can dispense granules of human consumable salt. The human consumable colored salt can include salt having different colors, each of the different colors being contained in a different one of the salt chambers. The different colors can include colors of the color themed entity or event.

Still another aspect of the disclosure includes a salt dispensing system that includes a salt dispenser having a set of two or more salt chambers for containing human consumable salt. Each salt chamber of the salt dispenser can be isolated from each other salt chamber to prevent salt from one of the salt chambers from mixing with salt of any other of the salt chambers. Each of the salt chambers can include a transparent region though which salt within the salt chamber is viewable. A body of the salt dispenser can have a characteristic shape of the color themed entity or event, such as a sports team, a holiday, or a profession. Upon sale of the salt dispenser at a point of sale storefront, each salt chamber of the salt dispenser can include a human consumable colored salt of different colors, each of the different colors being contained in a different one of the salt chambers, where the different colors include the colors of the color themed entity or event. In one embodiment, the storefront can include a refiller of different colored salt able to be selected, purchased, and used to fill the salt chambers of the salt dispenser at a time of sale. In another embodiment, the salt dispenser can be segmented, where different segments including different colors of human consumable salt are for sale in the storefront to be combined at a time of sale or after to form a customer-selected color scheme matching that of the color themed entity or event. In still another embodiment, the salt dispenser can include different attachable and detachable salt chambers, where different detachable chambers including different colors of human consumable salt are for sale in the storefront to be combined at a time of sale or after to form a customer-selected color scheme matching that of the color themed entity or event.

DETAILED DESCRIPTION

The disclosure teaches a divided salt dispenser (e.g., shaker) that includes two or more salt chambers able to be filled with different colors of salt. The colors of the salt can match sports team's colors, sports organizational colors, or other color distinctive scheme suitable for a situation. For example, for 4th of July, a special red/white/blue salt shaker can be created and marketed. The dispenser can be in the shape and/or color of a sports team and/or sport related item. For instance, the shaker can be shaped like a football, basketball, hockey puck, flag, and the like. An inscription and/or indicia can be attached to the dispenser including, but not limited to, team names, team logos, symbols, crests, personalized lettering, and the like. Specialized salt dispenser refillers can be utilized to create salt dispensers with user configured colors.

Figure 1A:
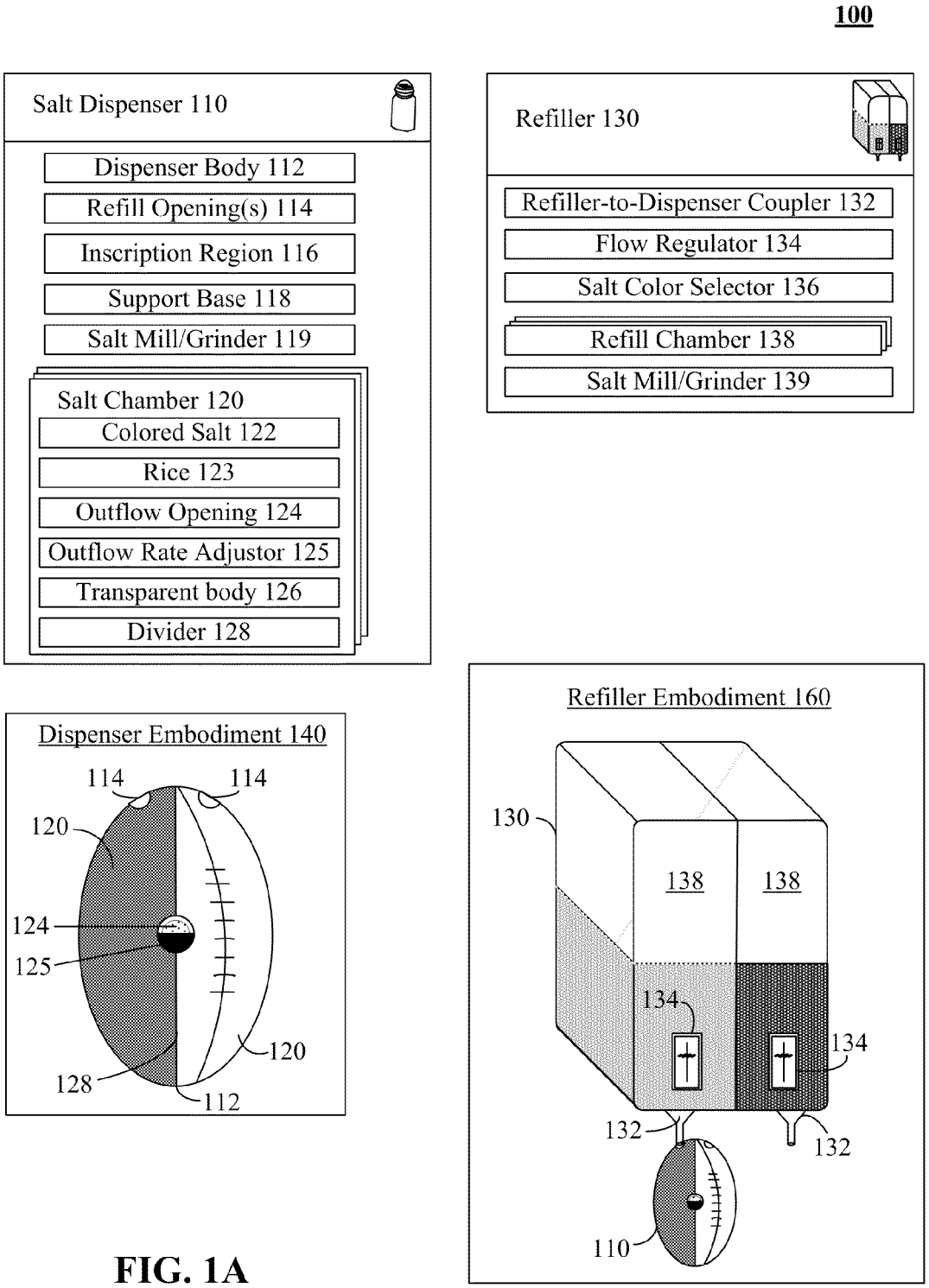
FIG. 1A is a schematic diagram illustrating a divided salt dispenser having sports related characteristics and a dispenser refiller in accordance with an embodiment of the inventive arrangements disclosed herein.
Figure 1B:
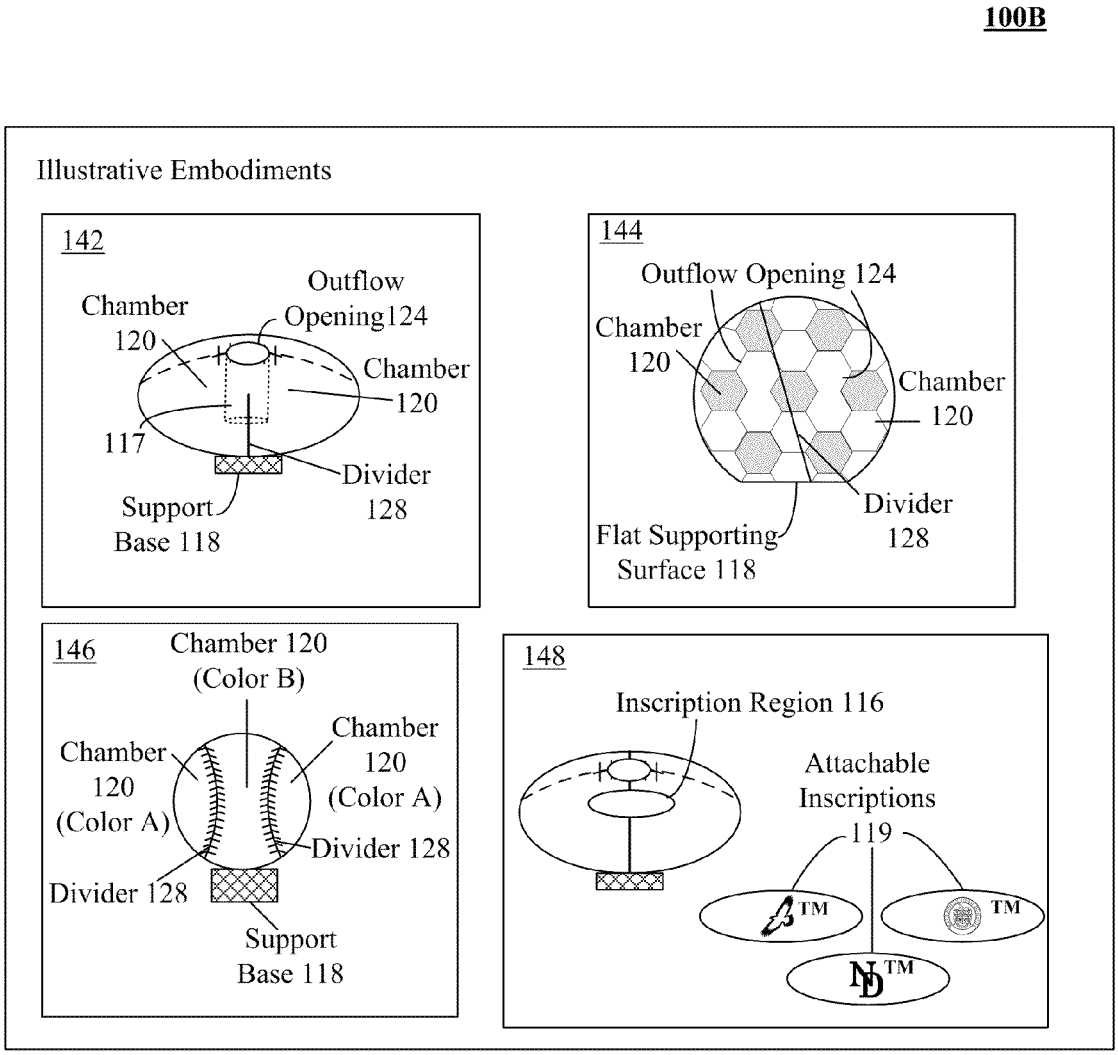
FIG. 1B is a schematic diagram illustrating embodiments of salt dispensers in accordance with an embodiment of the inventive arrangements disclosed herein.
Figure 2:
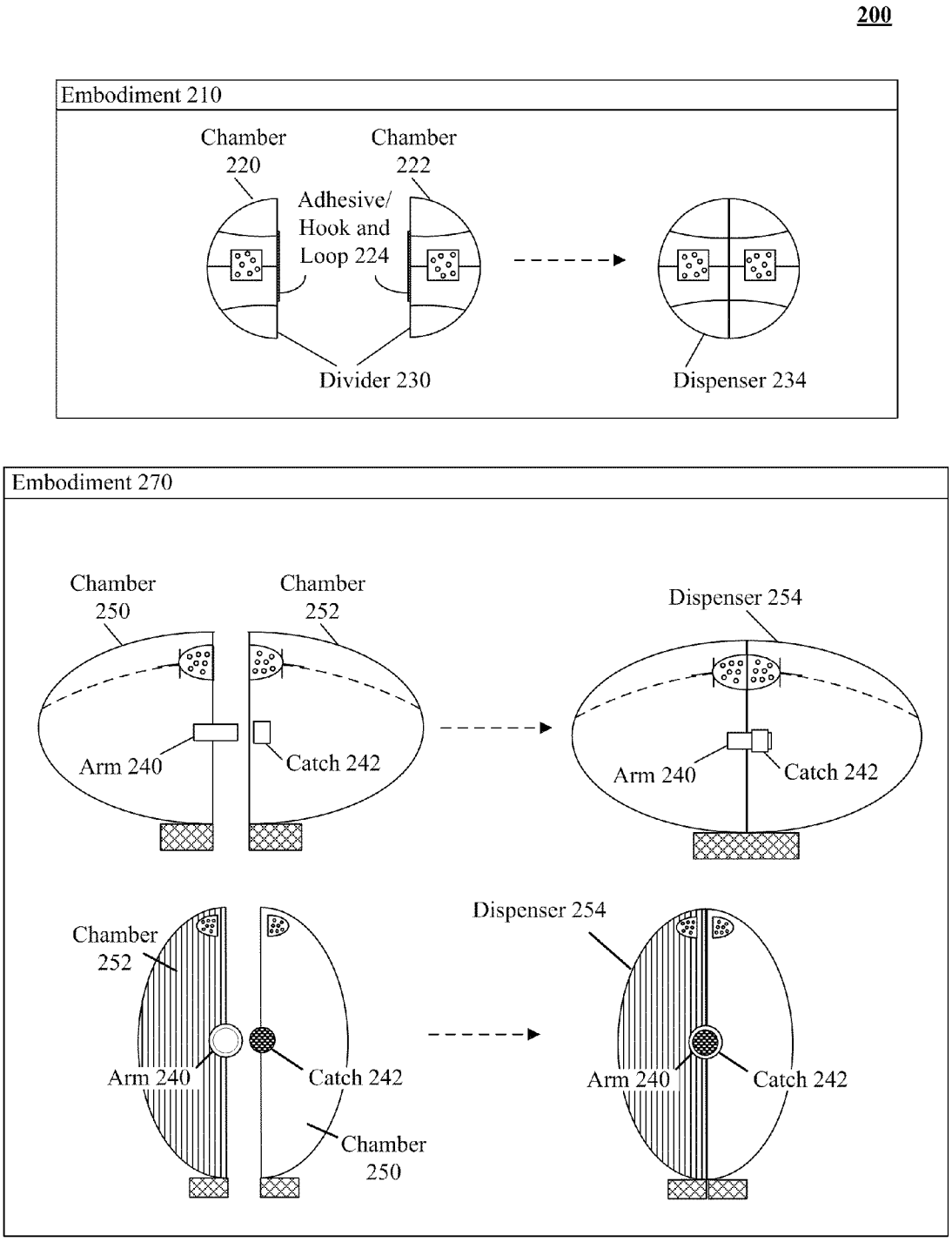
FIG. 2 is a schematic diagram illustrating a set of scenarios for coupling and decoupling mechanisms of a divided salt dispenser in accordance with an embodiment of the inventive arrangements disclosed herein.

This invention may be embodied in other forms without departing from the spirit or essential attributes thereof. It should be appreciated that the illustrations of FIGS. 1A, 1B and 2 are not intended to be exhaustive and that the invention is not to be construed as limited to specific details shown therein. Further, although dispenser embodiments (e.g., 110, 140, 142, 144, 146, 148, 210 and 270) are shown for simplicity of expression in FIGS. 1A, 1B and 2 as various sporting equipment with dual chambers (e.g., 220, 222, 250, and 252), they are not to be construed as limited in this regard. Embodiments exist where dispensers can have any shape (e.g., cowboy hat, musical instrument, palm tree, comic book character, alphabet letter, etc.) size, or number of chambers (e.g., 120, 220, 222, 250, and 252).

Salt, as used herein, is a crystalline solid, dietary mineral for human consumption that is composed primarily of sodium chloride. The salt of dispenser 110 and refiller 130 can include refined salt (e.g., table salt), unrefined salt (e.g., sea salt), and iodized salt. Refined salt can be refined from mined rock salt (halite) or from sea salt. Iodized salt can be a salt mixed with a minute amount of one of four iodine containing salts of hydriodic acid or iodic acid: potassium iodate or potassium iodide, and sodium iodate or sodium iodide. Refined edible salt is commonly iodized by spraying it with a potassium iodate solution.

The salt can optionally include intentionally added impurities. These impurities can be added for coloration of otherwise clear salt crystals, for flavor (e.g., flavor infused salts), and to prevent clumping (e.g., adding rice). The salt can be shaped in small granules or in coarse granules, which need to be grinded or milled before/as dispensing occurs.

Coloration of edible colored salts can be achieved in numerous contemplated ways. One contemplated way is to add an edible food coloring (e.g., color additive) to an edible salt. The color additive can include dyes (dissolvable in water but not soluble in oil) and lakes (a combination of dyes and insoluble materials that tint by dispersion).

The edible food coloring can be a digestible substance (e.g., a vegetable dye) used to give color to food. Edible food colorings used to dye salt can be natural (e.g., caramel coloring from caramelized sugar, Annatto, green dye from chlorella algae, Cochineal, Betanin, Turmeric, Saffron, Paprika, Elderberry, etc.) or synthetic (e.g., Federal Food, Drug, and Cosmetic Act (FD&C) Blue No. 1, FD&C Blue No. 2, FD&C Green No. 3, FD&C Red No. 40, FD&C Red No. 3, FD&C Yellow No. 5, FD&C Yellow No. 6, FD&C Red No. 2, FD&C Red No. 4, FD&C Red No. 32, FD&C Orange No. 1, FD&C Orange No. 2, FD&C Yellows No. 1, 2, 3, and 4, FD&C Violet No. 1, etc.).

Salt colors can also be natural and characteristic of a particular type of salt. Naturally colored salts include, but are not limited to: black salt (e.g., Kala Namak, Sanchal), Celtic Salt (e.g., French Grey Sea Salt), coarse salt (e.g., Gos Sel, Sale Grosso), flake salt, Fleur de Sel, French Sea Salt, Grey Salt (e.g., Sel Orris, Celtic Sea Salt), Hawaiian Sea Salt (e.g., Alaea, Alae, Hawaiian Red Salt), Italian Sea Salt (e.g., Sicilian Sea Salt, Sale Marino), Kosher Salt, Organic Salt, Smoked Sea Salt, etc.

FIG. 1 (includes FIGS. 1A and 1B) shows a divided salt dispenser 110 having two or more at least partially transparent chambers able to be filled with different colors of salt in accordance with an embodiment of the inventive arrangements disclosed herein. Any type of edible salt (described above) can be utilized with dispenser 110 or refiller 130. Additionally, any of a variety of salt coloration techniques can be utilized (described above) so long as different colored salts are separated within different ones of the salt chambers 120.

The salt dispenser 110 can include a dispenser body 112, one or more refill openings 114, an inscription region 116, a support base 118, a salt mill/grinder 119, two or more salt chambers 120, and/or other components. Not every component 112-120 shown need be included in every implementation of the salt dispenser 110. For example, refill openings 114 can be excluded from non-refillable embodiments.

The dispenser body 112 can be optionally shaped for a particular theme, which can also be consistent with a color combination of the colored salt 122 loaded in the salt chamber 120. For example, when the theme is a sports theme, the dispenser body 112 can be shaped like a characteristic object for that sport, such as a football (e.g., embodiments 140, 142, 148, and 270), a football helmet, a basketball (e.g., embodiment 210) a baseball (e.g., embodiment 146), a bat, a soccer ball (e.g., embodiment 144), a golf ball, a golf club, a golf bag, and the like. When the theme is a holiday theme, the dispenser body 112 can be shaped like an object representative of a particular holiday, such as a heart (Valentine's Day), a shamrock (St. Patrick's Day), a flag (Independence Day), a jack-o-lantern (Halloween), a ghost, a turkey (Thanksgiving), a pilgrim, a Santa Clause (Christmas), a reindeer, a snowman, and the like. When the theme is for a particular business, the body 112 can be shaped for that business, such as a scale of justice (law), a house (real-estate), a cow (dairy industry), and the like. Characteristic corporate colors (such as those of a logo/stationary) can be colors used for the colored salt 122 in a business embodiment.

The refill opening 114 can be an optional component included in refillable dispensers 110, as opposed to sealed/throw-away dispenser 110 embodiments. In one embodiment, the refill openings 114 can be designed to be coupled to an outflow mechanism of a refiller 130 (e.g., embodiment 160). In one embodiment, one refillable opening 114 can exist per chamber 120 (e.g., embodiment 140 having two refill openings). In another embodiment, a single refill opening 114 can be included, which selectively flows (via a flow directing mechanism) into any of the salt chambers 120. In such an embodiment, a user can manipulate the flow directing mechanism to select or choose which chamber 120 incoming salt is to be directed. In one embodiment, the refill opening 114 can be positioned to be hidden during normal dispenser 110 usage. In one embodiment, the refill opening 114 can bear distinctive coloration and/or shape compatible with the dispenser body shape 112. For example, an opening 114 can be shaped/colored to look like an air intake of a football, when the dispenser body 112 is football shaped.

Inscription region 116 can be an area on the dispenser 110 and/or dispenser body 112 which can present customized indicia (e.g., embodiment 148). The indicia can include logos, symbols, crests, organizational logos, personalized lettering, and the like. Inscription region 116 can be prominently displayed on the dispenser 110 which can identify the dispenser as being associated with a particular team and/or sport. User customizations can be applied to the region 116 of the dispenser 110, such as engraving, painting, embossing, decaling, and the like.

In one embodiment, the inscription region 116 can be designed to be detachably coupled to removable inscriptions. The coupling mechanism for the inscription region can be a magnetic mechanism, a hook-and-loop fastener, a mechanical coupling, a sticker, and the like. In one example, different attachable labels (e.g., a set of medallions—one for each NFL football team) can exist, where a user can selectively couple a user selected one of the labels to the region 116.

The support base 118 can be a region of the dispenser 110 designed to keep the dispenser 110 stable upon a surface, such as a table. The base 118 can be part of the dispenser 110 (e.g., embodiment 144) and/or can be implemented as a detached holder (e.g., embodiments 142, 146) designed for supporting the shape of the dispenser body 118. In one embodiment, the support base 118 can be permanently attached to the body 112 using an adhesive or glue. The support base 118 can also be manufactured into the dispenser 110.

The salt mill/grinder 119 (or 139) can be an optional component of the dispenser 110 (or refiller 130) for grinding large coarse crystals of salt (e.g., rock salt, sea salt, etc.) into small granules, which can be dispensed for consumption. The salt mill/grinder 119, 139 can be a manual or electronic component.

Two or more salt chambers 120 can be included in each salt dispenser 110. Each salt chamber 120 can include a transparent section (e.g., transparent body 126) through which the colored salt 122 can be viewed or can be entirely transparent so that all contained colored salt 122 is externally visible. In one embodiment, salt chambers 120 can be implemented as detachable cartridges which can be selectively added and removed from the dispenser 110. Thus, different colored salt cartridges can be selectively inserted to achieve a desired color combination for the salt dispenser 110. In another embodiment, the chamber 120 can be integrated in a fixed manner to the dispenser body 112. Either way, one or more dividers 128 will exist keep the colored salt 122 separated on a chamber-by-chamber basis. Additionally, optional additional substances, such as rice 123 that reduces moisture to prevent salt 122 from clumping, can be included in the chamber 120. Although salt chambers 120 can be of an arbitrary size depending on implementation specifics, each chamber 120 will typically hold between 0.5 and 12 ounces of salt.

Each chamber 120 can include one or more outflow openings 124 and an optional outflow rate adjustor 125. An outflow opening 124 can be an outlet through which colored salt 122 can flow from the chamber 120. In one embodiment, the outflow opening 124 can also be the refill opening 114. The outflow opening 124 can directly connect to an external environment or can be coupled to a flow conduit of the dispenser body 112, which connects to the external environment. In one embodiment, a single outflow opening 124 can permit salt to flow from multiple chambers 120 (e.g., dispenser embodiment 140). In another embodiment, each chamber 120 of the dispenser 110 can have a chamber specific opening (e.g., embodiment 144).

The optional outflow rate adjuster 125 can be any mechanism able to selectively increase/decrease a flow of salt 122 from the dispenser 110. The adjuster 125 can be manually adjusted by a user. In one embodiment, the adjuster 125 can include a rotatable couple having a set of holes or openings, which can be either aligned to holes of the outflow opening (124) to increase flow or can be misaligned to decrease flow.

Numerous non-restrictive examples of contemplated dispenser 110 implementations are shown in the figures as embodiments 140-148, which shall be briefly elaborated upon. Embodiment 140 shows a football shaped dispenser 110 having two chambers 120, each including different colored salt. The body 112 of the football shaped dispenser can be entirely clear, such as made of glass, plastic, crystal, or other clear material. Embodiment 140 lacks an explicit inscription region 116 and may require an external support base 118, which is not shown in FIG. 1. Two different refill openings 114 (one per chamber) are shown. Further, embodiment 140 also shows a single outflow opening 124 and common outflow rate adjustor 125. The divider 128 separating chambers in embodiment 140 bisects the football lengthwise.

Embodiment 142 is approximately equivalent to embodiment 140, with a few exceptions. First, except two chambers are divided along a different plane from embodiment 140. Further, a mixing chamber 117 is included between the two chambers 120 within which salt from the two different chambers can mix. A one-way flow valve can be included to prevent backflow from the mixing chamber 117 to each discrete chamber 120 to prevent intra-chamber mixing of different colors of salt.

Embodiment 144 shows a soccer ball shaped dispenser 110 having multiple outflow openings 124, one per chamber 120. The body of the dispenser 110 in embodiment 144 has a flat supporting surface 118. As shown, the divider 128 bisects the soccer ball shape to create two divided chambers.

In one contemplated derivative of embodiment 144, internal flow paths linked to interior chambers 120 can be included, where the flow paths are directed to different hexagons of the soccer ball shape. Assuming one interior chamber 120 includes a dark colored salt and a different interior chamber 120 includes a light colored salt, then each hexagon having a flow path linked to a dark colored salt can be separated from other dark hexagons by at least one light hexagon (which is linked to an interior chamber containing light colored salt).

Embodiment 146 shows a baseball shaped dispenser 110 that includes two curved dividers 128, which match the stitching or seams of the baseball. With two dividers 128, the baseball can have three different chambers 120, each able to hold salt 122. In one embodiment, different colors of salt 122 can be included in each chamber 120. In another embodiment, two colors of salt 122 can be included in the dispenser, where one color (e.g., Color A, as shown) is included in two chambers 120, which is separated by a chamber 120 including the other color (e.g., Color B). Embodiment 146 can be a pre-loaded throw-away embodiment of a multi-chambered dispenser 110.

Embodiment 148 shows football shaped dispenser 110 having an inscription region 116. One or more attachable labels 119 including inscriptions can be attached to this region 116.

The refiller 130 can be utilized to move salt into the salt dispenser 110. In one embodiment, the refiller 130 designed for use at a point of sale storefront. Hence, a customer can select a shape and/or inscription for an otherwise empty dispenser 110, which can be filled by a point of sale agent and/or the customer to suit their color preference. For example, a store (storefront or e-commerce based) selling sports paraphernalia can stock empty salt dispensers 110, and a refiller 130 having all salt colors to match those of major sports team color schemes. This arrangement can minimize on-hand inventory and stocking costs while ensuring high availability of customer desired inventory. In an alternative embodiment, refill units can be sold as discrete for-sale units, which are designed to provide one or more recharges for a salt chamber 120.

Numerous alternatives (other than use of refiller 130) are contemplated that achieve the same ends of achieving a high availability of customer desired inventory while minimizing stocking costs. For example, as previously mentioned, cartridge-like, detachable salt chambers 120 can be utilized so that customers can select chambers 120 prefilled with desired colors to create a color scheme of their choice. In another embodiment (shown in FIG. 2), the dispenser 110 itself can be constructed in attachable segments, which can be coupled together as desired. Embodiments with selectively formed color combinations can be extremely valuable in situations where a need for different color combinations is anticipated. For example, a sports bar would be expected to need to create different team-themed color combinations for colored salt dispensers 110 depending on which sports event is being presented at the bar. In another example, a catering service can be expected to require different color combinations depending on color schemes appropriate for an event (e.g., holiday colors, personal color selections corresponding to wedding party colors, corporate colors, etc.).

Turning to embodiments 210, 270 shown in FIG. 2, dispensers 234, 254 can be created through coupling two or more chambers 220, 222, 250, 252 together. Coupling can be achieved through adhesive or non-adhesive means. Dispenser 234 can utilize adhesive materials to combine chambers 220 and 222. The adhesive 224 can be a permanent adhesive, such as a glue, or a non-permanent adhesive. Permanent adhesives can include contact adhesives, drying adhesives, synthetic adhesives, and the like. Non-permanent adhesive can include a hook and loop fastener, a magnetic coupling mechanism, and the like. Dispenser 254 can employ non-adhesive (e.g., friction fit) mechanisms to join chambers 250, 252. For example, a coupling mechanism including an arm 240 and catch 242 can be fitted together allowing chambers 250, 252 to be tightly coupled as dispenser 254. That is, arm 240 can have securing ridge to which can allow catch 242 can be fitted. Using this (or a similar) coupling mechanism, dispenser 254 can be quickly coupled and decoupled, allowing different combinations to be created over time.

Regardless of whether a salt refiller 130, attachable discrete dispenser 110 segments (e.g., embodiment 210, 270), or cartridge-like attachable salt chambers 120 are utilized, any of these techniques implemented in a storefront can increase customer visitations, which provides an opportunity for increased sales of other storefront items. Moreover, use of an in-store refiller 130, cartridge-like chambers 120, or segmented dispenser 110 provides an opportunity for a recurring income stream.

To elaborate upon the refiller 130, the refiller 130 can include a refiller-to-dispenser coupler 132, a flow regulator 134, a salt color selector 136, one or more refill chambers 138, a salt mill/grinder 139, and/or other such components. The coupler 132 can be designed for pairing with the refill opening 114 of a dispenser 110. In one embodiment, a refiller 130 can include multiple couplers 132, such as one per refill chamber 138. In another embodiment, the refiller 130 can include a single coupler 132 that has a selectable flow path to each refill chamber 138. Each refill chamber 138, when full, can include a sufficient quantity of salt to completely fill at least five empty salt chambers 120. In one embodiment, significantly more than five empty salt chambers 120. Typical capacities of each refiller chamber 138 can be from one to twenty pounds of salt.

An optional salt color selector 136 can be a user interface (e.g., a set of buttons, a positional flow directing switch, etc.) for directing which of many chambers 138 the coupler 132 is linked. The color selector 136 can, but need not, display a color to a user. For example, in one embodiment the selector 136 can display a chamber number or other selectable identifier, which a user can select. In one embodiment, a user can select via a selector 136 or other interface, a color-themed object, such as a holiday, a sports team, etc. Colors suitable for that team can be automatically displayed to a user (who selected a button for a team/holiday) and/or determined and corresponding colors of salt dispensed by refiller 130.

In one embodiment, both dispenser 110 and refiller 130 can have flow paths to/from a single opening that lead to multiple chambers. In which case, a pairing of the coupler 132 and opening 114 can be formed so that when a given color is selected from the refiller 130, it is placed in a discrete chamber of the dispenser 110 and when the refiller 130 changes from one color to another (one refill chamber 138), the dispenser chamber 120 can be automatically changed. Thus, when dispenser 110 and refiller 130 are coupled, a user single selection of a color-themed object, can initiate a process that results in suitable colors for that selection being loaded into the chambers 120 of the dispenser 110. Hence, a store agent can press a "load dispenser 110 for Team A" button, when the dispenser 110 is coupled to refiller 130, walk away, and be ensured that the chambers 120 will ultimately be filled with salt having Team A's colors.

Flow regular 134 can be any mechanism used to change a flow rate of salt from a refill chamber 138. The flow regular 134 can be a manual or automated (e.g., electrically coupled) component of the refiller 130. In its simplest form, the flow regulator 134 can trigger a flow-on and a flow-off state. In one contemplated embodiment, a level sensor included in the dispenser 110 can detect when a chamber 120 has been filled, can communicate this to the refiller 130, which automatically adjusts the flow regular 134 to halt an output flow of salt so as to prevent overflow and/or overfilling of the dispenser 110. In another embodiment, the flow regulator 134 can be coupled to an outflow meter which limits output from the refiller 130 for a given activation to a fixed amount, where preset amounts can exist for filling chambers 120 with known sizes.

The description of the disclosure together with the diagrams and figures embodied in FIGS. 1A, 1B and 2 have been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The diagrams in the FIGS. 1A, 1B, and 2 illustrate the architecture, functionality, and operation of possible implementations of systems, methods and products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

What is claimed is:

1. A salt dispenser comprising:

a dispenser body having a shape characteristic of a type of sport, said shape being at least one of a shape of a type of ball used in said sport, a type of helmet worn when participating in said sport, jersey worn when participating in said sport, a ball manipulating device carried and used by a participant of said sport, a vehicle driven when participating in said sport, and a player of said sport, said dispenser body comprising a visible indicia for a specific team for said sport, said specific team having a color theme comprising at least two colors associated with said specific team, said visible indicia comprising at least one of a team name, a team logo, and a team abbreviation;

a plurality of salt chambers containing human consumable colored salt that is viewable through said dispenser body, each of said salt chambers isolated from each other to prevent salt from one of the salt chambers from mixing with salt of any other of the salt chambers, said human consumable colored salt comprising salt having a plurality of different colors, each of the different colors being contained in a different one of said chambers, wherein said different colors comprise said at least two colors associated with said specific team; and at least one outflow opening for dispensing granules of human consumable salt from the salt dispenser to edible food, wherein said at least one outflow opening is formed so that human consumable salt from a plurality of different salt chambers is concurrently dispensed to the edible food when the salt dispenser is utilized.

2. The salt dispenser of claim 1, wherein each of said salt chambers is selectively detachable and attachable from said dispenser body.

3. The salt dispenser of claim 1, wherein said dispenser body comprises a plurality segments, each segment comprising at least one of said salt chambers, wherein said segments are able to be selectively coupled to one another to form said shape characteristic of the type of sport.

4. A salt dispenser comprising:

a dispenser body having a visible indicia for a colored themed entity or event;

a plurality of salt chambers for containing human consumable salt, each isolated from each other to prevent salt from one of the chambers from mixing with salt of any other of the chambers, wherein each of the chambers comprises a transparent region though which salt within the chamber is viewable;

an outflow opening for dispensing granules of human consumable salt; and human consumable colored salt of a plurality of different colors, each of the different colors being contained in a different one of said chambers, wherein said different colors comprise colors of said color themed entity or event.

5. The salt dispenser of claim 4, wherein said visible indicia of the dispenser body comprises the dispenser body having a characteristic shape of the color themed entity or event.

6. The salt dispenser of claim 5, wherein said dispenser body having said characteristic shape comprises a plurality segments, each segment comprising at least one of said chambers, wherein said segments are able to be selectively coupled to one another to form said dispenser body.

7. The salt dispenser of claim 4, wherein said color themed entity or event is a sports team, wherein said different colors of salt consist of the colors associated with said sports team.

8. The salt dispenser of claim 4, wherein said color themed entity or event is a holiday, wherein said different colors of salt consist of the colors associated with said holiday.

9. The salt dispenser of claim 4, further comprising:

an inscription region, said inscription region comprising at least one of a name and logo for said color themed entity or event.

10. The salt dispenser of claim 9, further comprising:

a plurality of attachable labels, each comprising at least one of a name and logo for said color themed entity or event, wherein each of said attachable labels comprises a coupling means for coupling the attachable label to said inscription region.

11. The salt dispenser of claim 4, wherein said human consumable colored salt of the plurality of different colors is salt color altered by an edible food coloring.

12. The salt dispenser of claim 4, wherein said human consumable colored salt of the plurality of different colors is naturally colored salt that has not been altered by an edible food coloring.

13. The salt dispenser of claim 4, wherein each of said salt chambers is selectively detachable and attachable from said dispenser body.

14. The salt dispenser of claim 4, wherein said outflow opening is a single outflow opening having a flow conduit to each of said plurality of salt chambers through which the human consumable colored salt in the salt chambers flows.

15. The salt dispenser of claim 14, wherein said human consumable colored salt in said salt chambers comprises large crystals, said salt dispenser further comprising:

a salt grinder for grinding said large crystals into finer grain granules which flow from said single outflow opening.

16. A salt dispensing system comprising a salt dispenser comprising a plurality of salt chambers for containing human consumable salt, each salt chamber of the salt dispenser isolated from each other salt chamber to prevent salt from one of the salt chambers from mixing with salt of any other of the salt chambers, wherein each of the chambers comprises a transparent region though which salt within the salt chamber is viewable, wherein a body of said salt dispenser has a characteristic shape of the color themed entity or event, wherein said color themed entity or event is selected from a group consisting of a sports team, a holiday, and a profession, wherein upon sale of said salt dispenser at a point of sale storefront, each salt chamber of said salt dispenser comprises a human consumable colored salt of a plurality of different colors, each of the different colors being contained in a different one of said salt chambers, wherein said different colors comprise colors of said color themed entity or event.

17. The salt dispensing system of claim 16, wherein the salt chambers of each of said salt dispensers are empty when placed in the storefront for customer selection before a sale, said point of sale storefront further comprising:

a refiller for filling salt dispensers at a time of sale with a customer selected ones of the different colors of the human consumable colored salt, said refiller comprising:

a plurality of refill chambers for containing human consumable salt of different colors, each refill chamber isolated from each other to prevent salt from one of the chambers from mixing with salt of any other of the chambers, each refill chamber when filled comprising a sufficient quantity of salt to refill at least five salt chambers of said salt dispensers;

a refiller-to-dispenser coupler configured to couple said refiller to said salt dispenser to permit salt to flow from said refill chambers to said salt chambers of said salt dispenser; and a flow regulator permitting a user of the refiller to selectively control a flow of salt from each of said refill chambers to said salt chambers of said salt dispenser when said salt dispenser is coupled to said refiller via said refiller-to-dispenser coupler.

18. The salt dispensing system of claim 16, wherein the body of said salt dispenser is formed as at least two distinct and selectively attachable segments, which result in said characteristic shape when attached, wherein each of said distinct segments comprises one of said salt chambers, wherein different segments are filled with different colored salt in a detached state when displayed in the storefront so a customer is able to select and separately purchase in said storefront different ones of the different segments containing different colored salt.

19. The salt dispensing system of claim 16, wherein the each of the plurality of salt chambers of said salt dispenser is selectively detachable and attachable from said body of the salt dispenser, wherein different detached salt chambers are filled with different colored salt in a detached state when displayed in the storefront so a customer is able to select and separately purchase in said storefront different ones of the different detached salt chambers containing different colored salt.

20. The salt dispensing system of claim 16, further comprising:

a plurality of labels each comprising at least one of a name and logo for said color themed entity or event, wherein labels comprising different names or logos are in a detached state when displayed in the storefront so a customer is able to select and separately purchase in said storefront different ones of said labels, wherein said salt dispenser comprises an inscription region of said body being sized and formed so that any of said labels are attachable to said inscription region by said customer.

* * * * *